US010016641B2

(12) United States Patent
Glen

(10) Patent No.: US 10,016,641 B2
(45) Date of Patent: Jul. 10, 2018

(54) SAFETY RAILCAR

(71) Applicant: Robert E. Glen, Newcastle (CA)

(72) Inventor: Robert E. Glen, Newcastle (CA)

( * ) Notice: Subject to any disclaimer, the term of this patent is extended or adjusted under 35 U.S.C. 154(b) by 336 days.

(21) Appl. No.: 14/867,410

(22) Filed: Sep. 28, 2015

(65) Prior Publication Data

US 2016/0089555 A1 Mar. 31, 2016

Related U.S. Application Data

(60) Provisional application No. 62/056,898, filed on Sep. 29, 2014.

(51) Int. Cl.

| | |
|---|---|
| ***A62C 3/06*** | (2006.01) |
| ***A62C 3/07*** | (2006.01) |
| ***A62C 37/36*** | (2006.01) |
| ***A62C 99/00*** | (2010.01) |
| ***B61D 5/02*** | (2006.01) |
| ***B61D 15/00*** | (2006.01) |
| ***B61D 5/00*** | (2006.01) |

(52) U.S. Cl.

CPC ..... *A62C 3/07* (2013.01); *A62C 3/065* (2013.01); *A62C 99/0036* (2013.01); *B61D 5/00* (2013.01); *B61D 5/02* (2013.01); *B61D 15/00* (2013.01)

(58) Field of Classification Search

CPC ..... A62C 3/065; A62C 3/07; A62C 37/04; A62C 37/36; A62C 37/38; A62C 37/40; A62C 37/44; A62C 99/0036; A62C 99/0072; B61D 5/00; B61D 5/02; B61D 15/00

See application file for complete search history.

(56) References Cited

U.S. PATENT DOCUMENTS

| | | | | |
|---|---|---|---|---|
| RE26,020 | E | 5/1966 | Powell | |
| 5,590,718 | A | 1/1997 | Bertossi | |
| 6,104,301 | A | 8/2000 | Golden | |
| 6,415,871 | B2 | 7/2002 | Sundholm | |
| 8,590,631 | B2 | 11/2013 | Sprakel et al. | |
| 2004/0084193 | A1 | 5/2004 | Tseng | |
| 2004/0163826 | A1 | 8/2004 | Spring | |
| 2007/0044979 | A1* | 3/2007 | Popp | A62C 3/08 169/60 |
| 2008/0223955 | A1* | 9/2008 | Sprakel | A62C 3/07 239/253 |
| 2011/0155398 | A1 | 6/2011 | Holland et al. | |
| 2012/0037383 | A1 | 2/2012 | Dirksmeier et al. | |
| 2012/0267126 | A1 | 10/2012 | Volk et al. | |

* cited by examiner

*Primary Examiner* — Darren W Gorman

(74) *Attorney, Agent, or Firm* — Renner, Otto, Boisselle and Sklar, LLP

(57) ABSTRACT

A suppression system for use in a safety railcar may include a source of pressurized water connected to at least one foam tank containing a suppression foam. A controllable valve mediates flow of pressurized water from the source of pressurized water to the at least one foam tank. The controllable valve is controllable to permit flow of pressurized water to the at least one foam tank in response to detection of a hazardous event. A spray nozzle is connected to the foam tank via a rupture disc that is configured to rupture and permit flow of suppression foam from the spray nozzle when pressure within the foam tank exceeds a predetermined threshold.

20 Claims, 8 Drawing Sheets

SAFETY RAILCAR

This application claims the benefit of and priority to U.S. Patent Application No. 62/056,898 filed Sep. 29, 2014.

FIELD

The present disclosure relates to systems for extinguishing fires on a train. In particular, the present disclosure relates to a safety railcar for extinguishing fires on a train.

BACKGROUND

Fires from transporting flammable goods have caused considerable human, financial, and environmental tragedies. Present day techniques of firefighting flammable liquids in a train derailment may be antiquated.

U.S. Pat. No. RE 26,020, Powell, is directed to protecting hydrocarbon containing tanks from fire, by encompassing a tank containing flammable liquids within a structure containing non-flammable liquids. U.S. Pat. No. 6,104,301, Golden, shows an automatic fire suppression system with heat and smoke sensors; applicability to railroad cars is described at column 11, lines 14-19.

U.S. Pat. No. 6,415,871, Sundholm, shows an installation for fighting fire in a (particular) space by optimizing spray head locations and angles. U.S. published application 20040163826, Spring, shows an inert gas supply for an automatic fire protection system. U.S. published application 20110155398, Holland et al., shows a fire extinguisher for a vehicle which can be activated by acceleration, speed, time, temperatures, fuel, fire, smoke, light, or the like. Applicability to railways is described at paragraph 11. U.S. published application 20120037383, Dirksmeier et al., shows a railroad fire protection fluid mist fed fire fighting device for fires between rail cars.

U.S. published application 20120267126, Volk et al., shows an automated fire fighting system for a railway vehicle, which dispenses fire suppressant at the interior of the vehicle (paragraph 4) connected to a computer. U.S. Pat. No. 5,590,718, Bertossi, teaches a fire suppression system responsive to collision sensors. U.S. Pat. No. 8,590,631, Sprakel et al., and U.S. published application 20040084193 (Tseng) teach an automated fire suppression system activated by collision or temperature.

None of the known prior art technologies can address a major accident involving rail cars carrying flammable or toxic materials.

Unfortunately, it typically takes a significant number of hours for firefighters to respond to a rail accident. Typically, the first responders do not know what the emergency situation entails, let alone have the materials and equipment in place to properly handle the situation. The first few minutes are usually critical when fighting fires involving large amounts of flammable substances. During this critical time the disaster may multiply exponentially and the fire may be considered out of control.

Responders may not wish to send their crew into a potentially high explosive situation due to the risk of the loss of life. The only option may be to "let it burn itself out", leading to a potential disaster.

SUMMARY

In some examples, the present disclosure provides a suppression system for use in a safety railcar, the suppression system may include: a source of pressurized water; at least one foam tank containing a suppression foam, each foam tank being connected to receive pressurized water from the source of pressurized water to pressurize the suppression foam; a controllable valve positioned to mediate flow of pressurized water from the source of pressurized water to the at least one foam tank; and at least one spray nozzle connected to receive the suppression foam from each foam tank, each spray nozzle being connected to the respective foam tank via a rupture disc configured to rupture and permit flow of suppression foam from the spray nozzle when pressure within the at least one foam tank exceeds a predetermined threshold; the controllable valve being controllable to permit flow of pressurized water to the at least one foam tank in response to detection of a hazardous event.

In some examples, the present disclosure provides a safety railcar including the suppression system.

In some examples, the present disclosure provides a train including one or more safety railcars.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
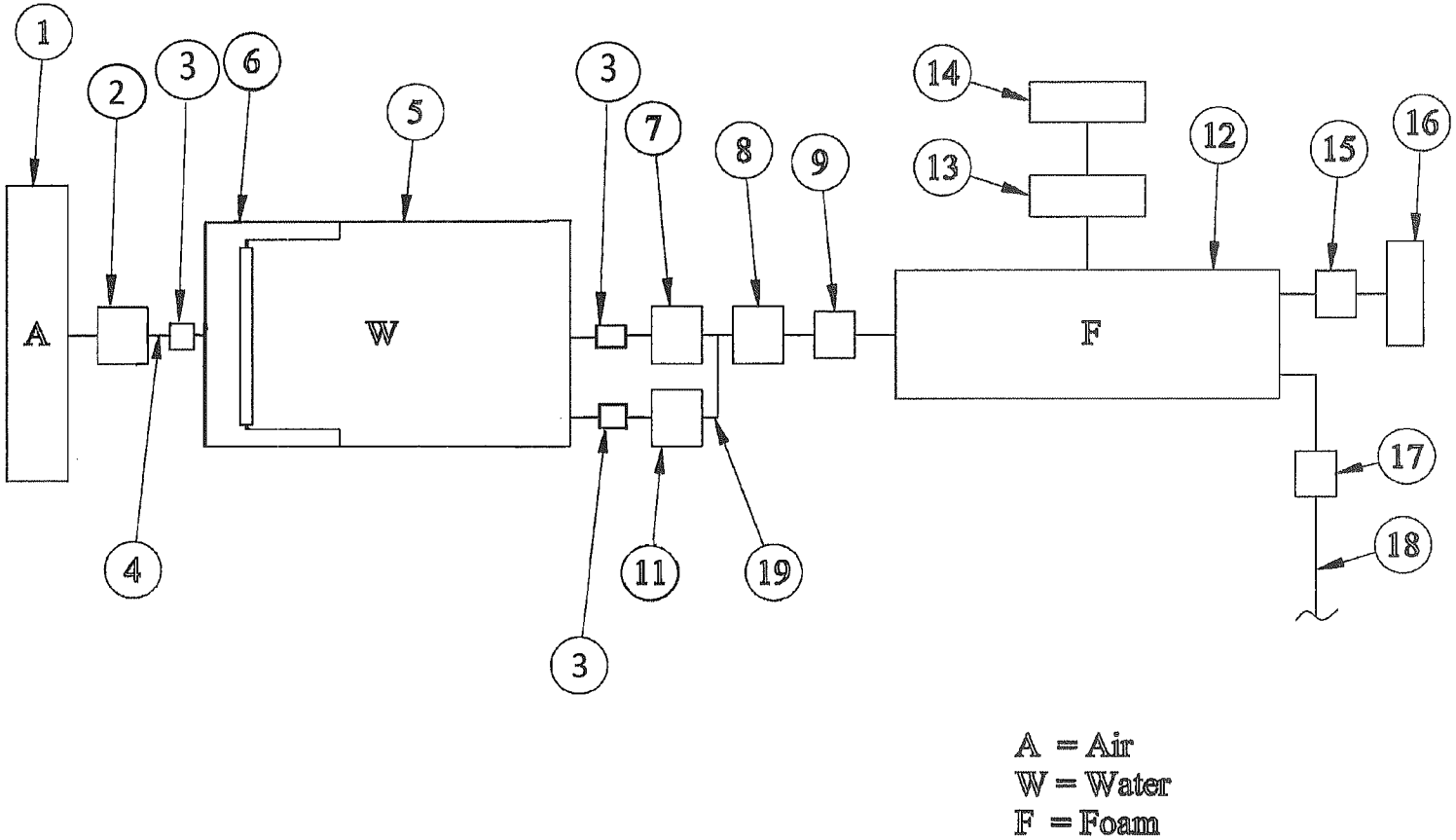
FIG. 1 is a schematic diagram of an example suppression system for a safety railcar.

The present disclosure describes a safety railcar (e.g., in the form of a tanker car) that may provide an automated and immediate fire suppression system for suppression of railway fires and/or of dangerous substances leaked from a train. One or more of the disclosed safety railcars may be strategically positioned within the train. The safety railcar may contain fire suppressant foam that may automatically deploy after detecting a derailment and/or fire. The present disclosure may enable a small initial fire on a train to be extinguished quickly, and may help prevent a significant disaster from occurring. The disclosed safety railcar may be useful for suppressing railcar fires (e.g., crude oil or flammable hazardous material railcar fires), such as in the event of a derailment.

In some examples, the safety railcar may include one or more radial tanks containing firefighting foam that may be connected to one or more central tanks containing water. The large central tanks may be in turn connected to one or more pressurized air cylinders, therefore making available a high pressure water source. The foam tanks may be initially not pressurized and may be attached to the water tanks with hoses that contain individual valves (e.g., solenoid valves) that are in a normally closed configuration.

There may be sensors, such as one or more accelerometers and/or infrared or ultraviolet detectors, strategically placed throughout the safety railcar. When a violent accident occurs, such as a derailment, the sensors may transmit an electrical signal to an on-board programmable logic controller (which may be powered by a battery). In response to receipt of the signal from the sensors, the controller may cause the valves to be opened, allowing pressurized water to enter specific foam tanks. This pressure may in turn break open rupture discs that are connected to radial spray nozzles on the affected foam tanks, thus ejecting foam in a radial direction under high pressure and at great distance. Each foam tank may include spray nozzles spaced radially to provide fire suppression capability in a 360 degree pattern. Spray nozzles may also be positioned on the foam tanks to eject foam in the fore and aft directions resulting in additional coverage. This arrangement may provide a more complete spherical fire suppressant capability, which may enable fire suppression even in a rollover scenario. As well, some spray nozzles on the Safety Railcar may be of the pivoting type. The pivoting nozzles may be controlled by wireless or direct means (wired).

In some examples, signals from both accelerometers and infrared or ultraviolet detectors may be required before the controller triggers opening of the valves. The accelerometers may sense an acceleration indicative of a derailment and may transmit a signal to the controller only when the sensed acceleration has a profile (e.g., sudden deceleration beyond a preset threshold) indicative of a derailment or crash, while the infrared or ultraviolet detectors may sense thermal change indicative of a fire and may transmit a signal to the controller only when the sensed temperature has a profile (e.g., above a preset temperature threshold) indicative of a fire. In some examples, where there are multiple infrared or ultraviolet detectors at different locations throughout a train, only the infrared or ultraviolet detectors close to a fire may send signals to the controller. The controller may in response cause opening of the valves only in the vicinity of the infrared or ultraviolet detectors that sent the signals. When multiple infrared or ultraviolet detectors send signals to the controller, this may indicate that a larger fire is detected, and the controller may activate ejection of foam from more nozzles and/or from more foam tanks, in order to increase foam coverage in the area of concern.

In some examples, a derailment need not be detected for the suppression equipment to activate. For example, the safety railcar may be configured to deploy foam when a fire is detected, even when the train is parked or when loading or unloading railcars. In such examples, accelerometers may not be needed.

In some examples, there may be multiple independent foam ejection systems each safety railcar, which may provide a degree of redundancy for effective fire suppression capability.

In some examples, a manual system may be included on the safety railcar. Such a system may enable firefighters to access fire suppression foam stored in the safety railcar. For example, the safety railcar may provide firefighting hoses that can be utilized by opening a series of manual valves.

Since there may be multiple safety railcars on a single train, a safety railcar that is more remote from the direct fire (and which may not have been triggered to automatically eject foam) can be used in manual mode by firefighters, which may add a higher degree of firefighting capability.

Although the present disclosure describes various examples in the context of fire suppression (e.g., crude oil fires), in some examples the present disclosure may provide systems to suppress other dangerous goods, including other flammable substances as well as toxic or poisonous substance releases. For example, in addition to or in place of infrared or ultraviolet detectors, other sensors (e.g., gas sensors) specific to the dangerous goods being transported can be incorporated. The safety railcar may eject a powder, fluid, foam or other suppressant (or combination suppressant), depending on the dangerous goods being transported. When transporting dangerous goods such as toxic or poisonous substances, it may be desirable for the suppression system to be triggered by a single event, that being the detection of the presence of the specific toxic or poisonous gas. In some examples, the controller may require receipt of signals from at least two sensors detecting the toxic or poisonous gas before activating the suppression system, to reduce the risk of false positives.

In some examples, alternative or additional sensors may be placed on the railcars containing dangerous goods such that signals may be transmitted wirelessly to the Safety Railcar in the event of a leak and/or fire. When a violent accident occurs, such as a derailment, the sensors may transmit an electrical signal to an programmable logic controller on the Safety Car. In response to receipt of the signal from the sensors, the controller may initiate emergency response measures as described above.

In some examples, the safety railcar may include an off switch, which when activated may send a signal to the programmable logic controller to close the valves and cease ejection of foam. The off switch may be manually activated, such as in the event of a false positive (e.g., where foam is ejected erroneously) or when the fire has been extinguished.

The safety railcar and overall suppression system may be designed in accordance with railway standards in effect for the countries in which they are to be used.

In some examples, the safety railcar may serve as a suppression system even when not part of a train. For example, a railcar containing dangerous goods may be stationed at a site (e.g., on the premises of a private business). A safety railcar can be parked in line with the railcar(s) containing dangerous goods, ready to deploy suppressant material upon detection of a gas leak, for example.

Examples of the present disclosure will now be described with reference to the figures.

FIG. 1 shows a schematic diagram of an example suppression system suitable for use in a safety railcar, in accordance with the present disclosure. In this example, the suppression system may be for the suppression of fire, although the suppression system may be adapted for suppression of other hazards (e.g., spill of toxic substances) in addition to or alternative to suppression of fire. The example of FIG. 1 includes pressurized cylinders of air (or an inert gas such as nitrogen) pressurizing a large tank of water which may flow into a foam tank. The foam tank may then eject firefighting foam through one or more nozzles when an accelerometer and an infrared or ultraviolet sensor transmit signals indicative of an accident and a fire, as described further below.

The example shown in FIG. 1 includes a source of pressurized water. The source of pressurized water may include one or more (e.g., a series of four or more) air tanks 1 (only one is shown for simplicity) containing pressurized (e.g., pressured in the range of about 2250 psi to 3000 psi) air (or an inert gas such as nitrogen) that are connected to a central water tank 5. A pressure regulator 2 may be used to regulate (e.g., reduce) the pressure leading to the central water tank 5 (e.g., down to about 400 psi). Each air tank 1 may be connected via a hose 4 (e.g., a flexible stainless steel braided hose) to the central water tank 5.

One or more foam tanks 12 (one is show for simplicity) are connected to the source of pressurized water (in this example, the water tank 5). In this example, there is a plurality of foam tanks 12 that are located about the central water tank 5. The foam tanks 12 may be equally spaced and may be positioned to radially surround the water tank 5. The foam tanks 12 contain a suitable suppression foam for suppressing a hazardous event (e.g., a fire suppression foam). The central water tank 5 is connected to the foam tanks 12 via controllable valves 7 (e.g., solenoid valves) which are normally closed. The valves 7 mediate flow of pressurized water from the water tank 5 to the foam tanks 12. There may be one valve 7 for each foam tank 12, or there may be one valve 7 mediating flow of pressurized water to some or all foam tanks 12 connected to the water tank 5. These valves 7 may be electrically actuated via a programmable logic controller 202 (see FIG. 7) and may be controlled to open in accordance with a logic sequence implemented by the controller 202 and described further below. Generally, the controller 202 may control the valve 7 to open when a hazardous event is detected. Each valve 7 may be provided with a pressure reducing valve 8 to help ensure that the pressure is suitably reduced to enable the foam spray to operate efficiently. There may be proportional valves 9 to help ensure the correct mixing ratio of water to foam, for example a ratio of 94 to 6 for fighting Class B fires. Other configurations can be used depending on the dangerous goods being transported, for example.

The central water tank 5 may be sized to accommodate both the total air volume and total foam volume to ensure a suitable ratio of water and foam. In the case of fighting flammable liquids, a ratio of 94 to 6 (water to foam) may be maintained, translating into a 6% foam, which may be suitable for fighting Class B fires (including fires from flammable liquids). The water tank 5 may be configured to accommodate other ratio configurations as appropriate. The central water tank 5 may contain a flexible bladder 6 that may ensure the total tank volume of water is available gravity free, regardless of the safety railcar orientation (e.g., in the event of a rollover).

The foam tank 12 may be interconnected between two adjacent central water tanks 5 (only one shown in FIG. 1 for simplicity) to help ensure a level of redundancy is achieved, such as in the case of a single ruptured central water tank 5 in a derailment. This will be further described below with reference to FIGS. 3A-3C.

There is at least one spray nozzle 14, 16 connected to the foam tank 12 for spraying foam. A rupture disc 13, 15 is positioned between the spray nozzle 14, 16 and the foam tank 12. The rupture disc 13, 15 is configured to rupture at a predetermined threshold pressure to permit foam to flow from the foam tank 12 out of the spray nozzle 14, 16. In FIG. 1, there are two spray nozzles 14, 16 with respective rupture discs 13, 15. The spray nozzle 14 may be positioned to spray foam in a radial direction, while the spray nozzle 16 may be oriented to spray foam in the fore or aft directions. In some examples, the rupture disc 15 and spray nozzle 16 may only be present at the fore and ends of the safety railcar.

When pressurized water is received, via the valves 7, 8, 9, by the foam tank 12, the pressure of the foam tank 12 increases above the threshold pressure of the rupture discs 13, 15. The rupture discs 13, 15 rupture, supplying pressurized foam to the spray nozzles 14, 16. The rupture discs 13, 15 may be designed to rupture at a selected pressure that is high enough to avoid unintentional rupture and low enough to be ruptured when pressurized water enters the foam tank 12.

The suppression system may include a first manually operable bypass valve 11 to allow the system (e.g., in safety railcars that are not directly involved in a fire) to be utilized by firefighters. This may ensure a significant amount of firefighting foam is available to the first responders when they arrive at the scene of a fire. In the case of manual intervention by firefighters, the manual valve 11 can be opened to bypass valve 7 and supply pressurized water via line 19. Pressurized water then flows through the pressure reducing valve 8 and the proportional valve 9 to the foam tank 12, to pressurize the foam tank 12. A second manually operable valve 17 may then be opened such that foam will be supplied to a hose outlet 18, which may be connectible to a hose for firefighting use. Manual valves 11 and 17 may be sized such that the operating pressure in the foam tank 12 will be below the burst pressure threshold of rupture disc 13 and 15, to ensure no loss of foam through the external spray nozzles 14 and 16. This lower pressure may also ensure safe operation of the fire hose when used by firefighters.

In some examples, non-return valves 3 may be situated throughout the suppression system, to inhibit or prevent backflow in the event of a tank rupture. The non-return valves 3 may help to ensure uninterrupted flow in the event of a tank rupture. For example, non-return valves 3 may be located between the air tank 1 and the central water tank 5. Non-return valves 3 may also be incorporated upstream of the manual valve 17 for use with manual 5 firefighting. Non-return valves 3 may also be located between the water and foam tanks.

In some examples, overpressure valves (not shown) may be situated throughout the suppression system, to provide safety pressure release and avoid a buildup of pressure that might damage the suppression system.

Figure 2:
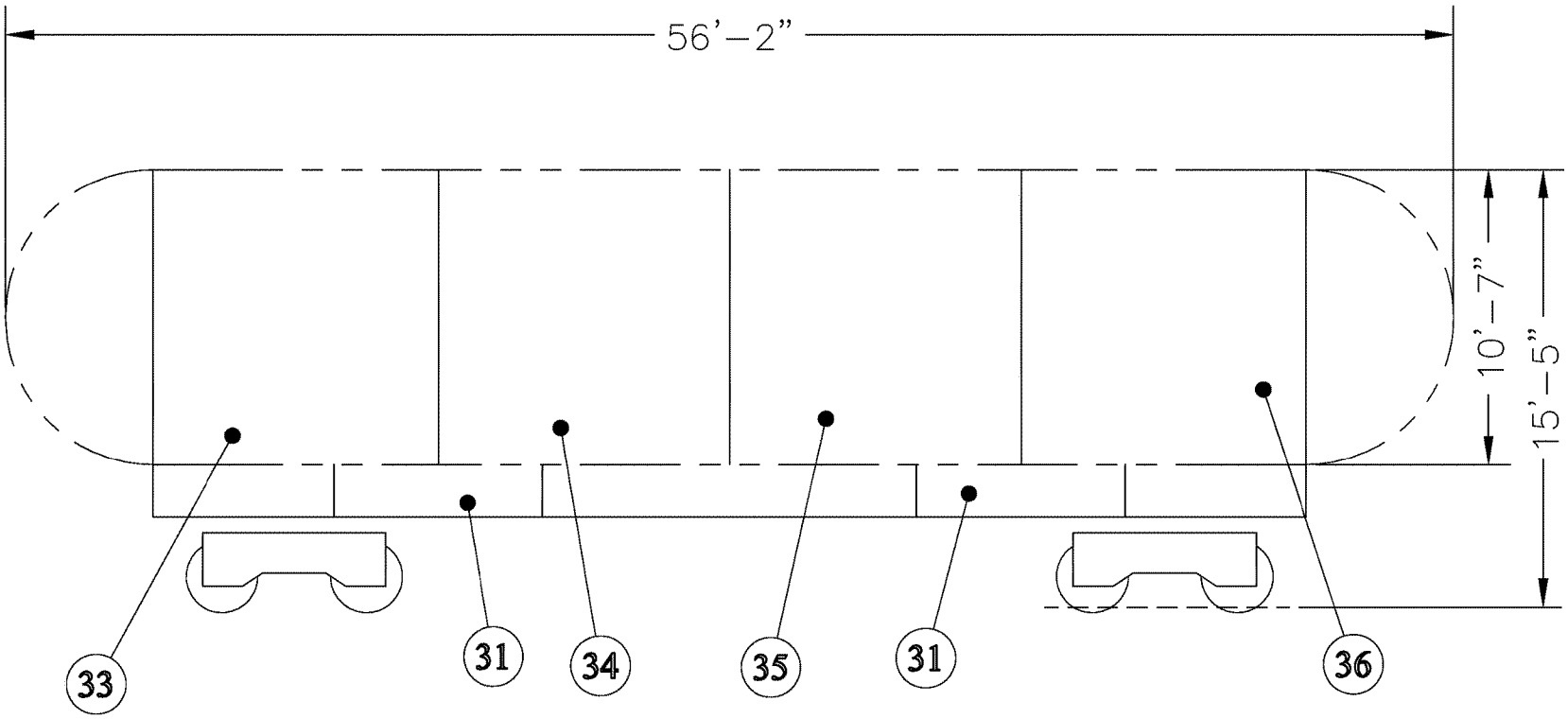
FIG. 2 is a schematic diagram of the example suppression system of FIG. 1 implemented in an example safety railcar.

FIG. 2 is a schematic diagram of how the example suppression system of FIG. 1 may be implemented in a safety railcar. In some examples, the safety railcar may be a DOT-111 railcar, adapted from a DOT-111 railcar, or have a design and construction similar to a DOT-111 railcar. In other examples, other railcar designs may be suitable. The suppression system may be housed in an automated spray compartment. Within one automated spray compartment, there may be four air tanks 1, one large central water tank 5, and twelve foam tanks 12 equally spaced in a radial orientation about the water tank 5. The schematic of FIG. 2 shows an example overall layout of a safety railcar having four automated spray compartments 33, 34, 35, and 36. In some examples, all four automated spray compartments 33, 34, 35, 36 may be considered to be part of a single suppression system. Example overall dimensions of the safety railcar are shown, specifically about 56'2" in length maximum, about 10'7" in height maximum (excluding wheels) and 15'5" in height maximum (including wheels). These dimensions may be similar to those of a typical tanker car.

There may be hoses (e.g., of four hoses) located in two or more hose compartments 31, to be used for manual firefighter efforts. These hoses may be any suitable firefighting hoses designed for spraying fire suppression foam. In some examples, the hoses may be at least two inches in diameter, about 1000 feet in length, and may be of the flexible layflat type. These hoses may be coiled around a large reel situated on a vertical axis to allow for quick deployment in the case of an emergency.

In some examples, the safety railcar may contain other equipment for dealing with the hazards associated with the payload being transported. For example, the safety railcar may include other firefighting equipment such as self contained breathing apparatus (SCBA), among other possible equipment.

Figure 3A:
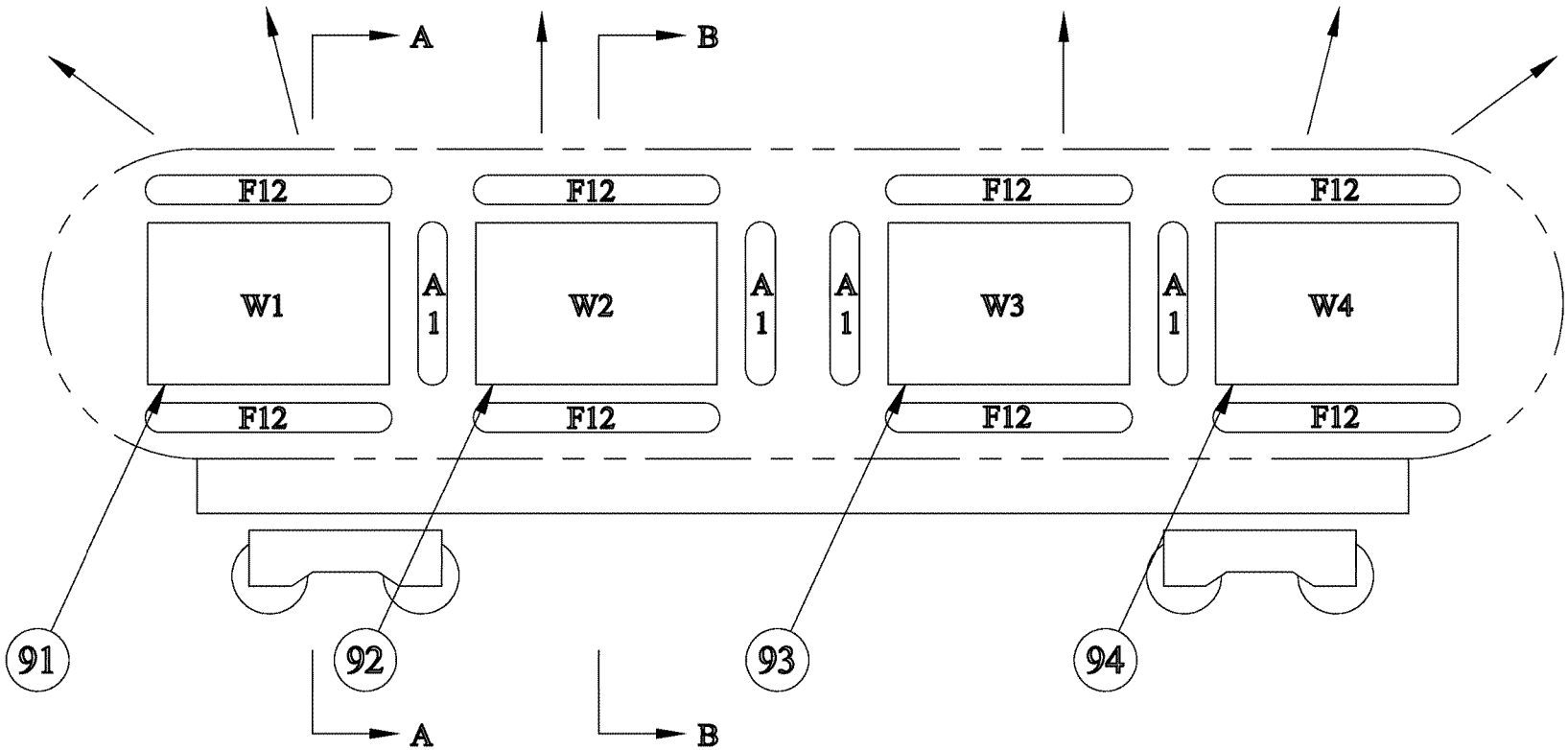
FIG. 3A is another schematic diagram of the example suppression system of FIG. 1 implemented in an example safety railcar.

FIG. 3A shows a detail layout of the example safety railcar of FIG. 2. In the example of FIG. 3A, a high degree of redundancy is provided that may be considered appropriate, based on previous accidents involving railcars, namely multiple shell punctures. A higher degree of redundancy may help to ensure a higher degree of firefighting capability even under the worst of conditions.

In this example, each water tank 91, 92, 93, 94 is surrounded radially by twelve foam tanks 12 and are each connected to provide pressurized water to foam tanks 12. However, each water tank 91, 92, 93, 94 may be connected with foam tanks 12 other than those surrounding itself. Arrows pointing outwards from the foam tanks 12 indicate examples of foam spray directions. Cross-sectional views A-A and B-B illustrate an example of such an arrangement.

Figure 3C:
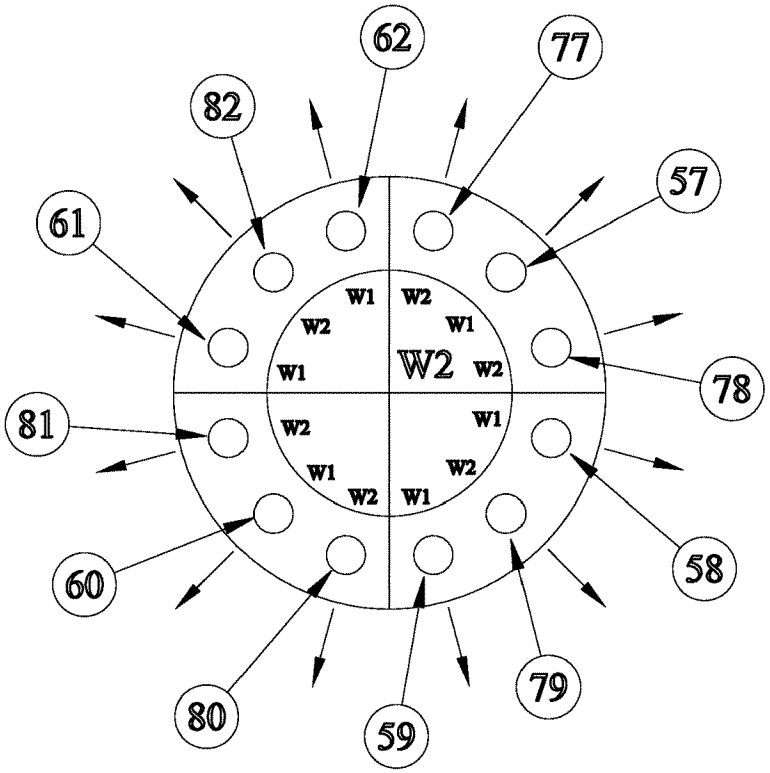
FIGS. 3B and 3C are cross-sectional views along A-A and B-B of FIG. 3A.
Figure 3B:
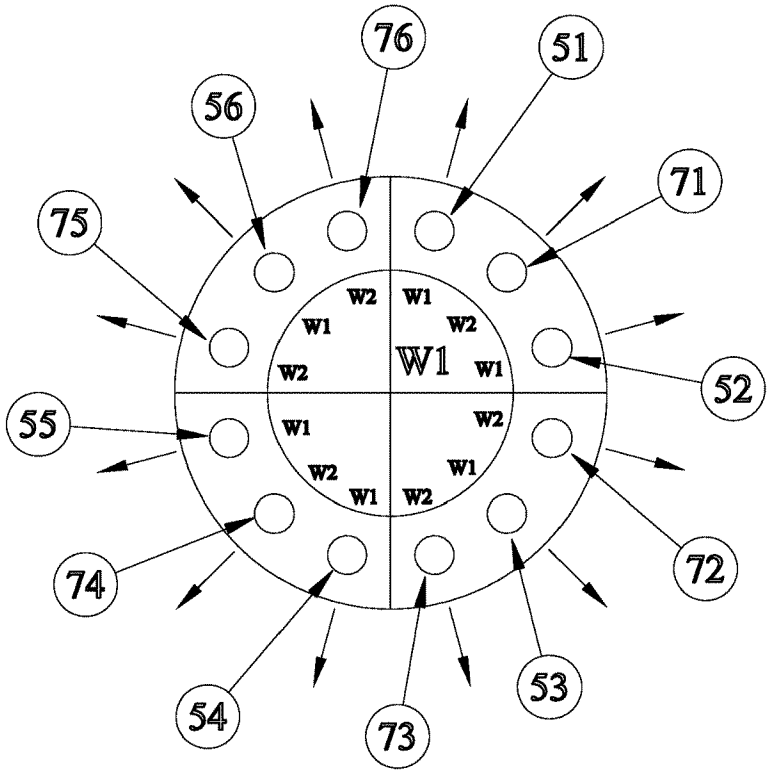

Cross-sectional view A-A is shown in FIG. 3B and represents a cross-section of water tanks 91 and 93 (also labeled as W1 and W3), while cross-sectional view B-B is shown in FIG. 3C and represents a cross-section of water tanks 92 and 94 (also labeled as W2 and W4). In this example, water tank 91 may be connected to provide pressurized water to foam tanks 51 to 62; notably, foam tanks 51 to 56 surround the water tank 91 itself while foam tanks 57 to 62 surround adjacent water tank 92. Similarly, water tank 92 may be connected to provide pressurized water to foam tanks 71 to 82; notably, foam tanks 71 to 76 surround adjacent water tank 91 while foam tanks 77 to 82 surround the water tank 92 itself. A similar arrangement may apply to water tanks 93 and 94. Thus, a high degree of redundancy may be provided, which may ensure that the ability to spray foam along the length of the safety railcar is not compromised by puncture of any one water tank 91 to 94.

In the example of FIGS. 3A-3C, the foam tanks 12 may be configured to spray foam outwardly in a radial direction (indicated by outward arrows in FIGS. 3B and 3C). The foam tanks 12 may be arranged evenly spaced about the water tank 5, for example about 30° apart from each other if there are twelve foam tanks 12 about the water tank 5. Although not shown in FIG. 3A, it should be understood that foam tanks 12 may also be positioned at the fore and aft ends of the safety railcar and may have similarly redundant connections to the water tanks 5.

The safety railcar may be designed to withstand damage in the event of a train accident. For example, the safety railcar may be designed to have a tank thickness of at least 0.75" steel, which may be thicker than the recommended thickness for conventional tanker cars. The spray nozzles may also be recessed in the safety railcar, to reduce the possibility of damage and/or occlusion of the spray nozzles (and possible subsequent leakage of foam) in the event of a rollover. The safety railcar may also include a rollover cage, as described with reference to FIG. 4.

Figure 4:
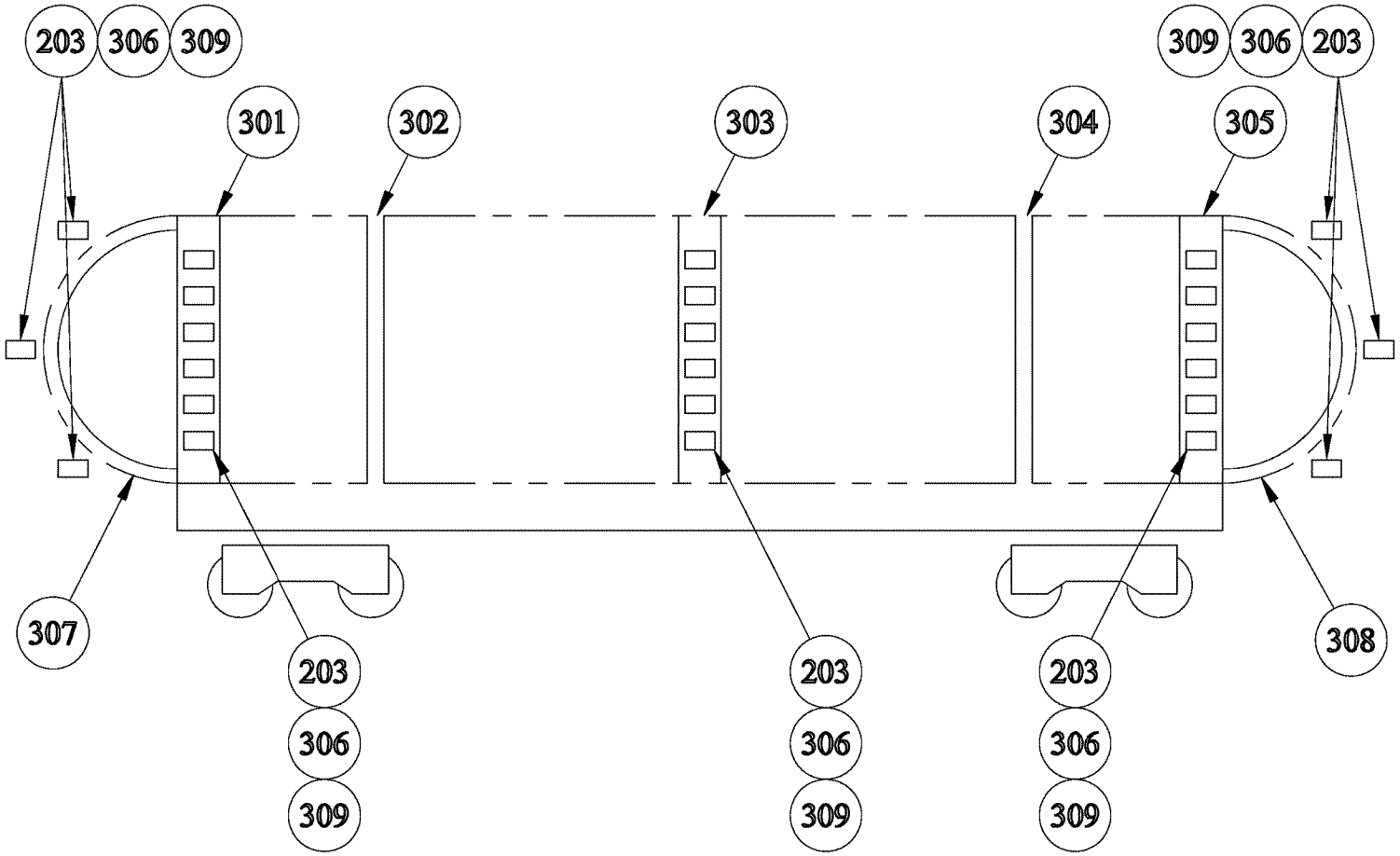
FIG. 4 is a diagram of the exterior of the example safety railcar of FIG. 3A.

FIG. 4 shows an example arrangement of a structural rollover cage 301 to 305, which may provide protection for the firefighting equipment in the safety railcar. Infrared and/or toxic gas substance sensors 306, 309 and accelerometers 203, which send signals to trigger activation of the suppression system, may be provided on the rollover cage 301 to 305. There may also be end shield protectors 307, 308 to help reduce the potential damage to any components of the firefighting system on the safety railcar. The infrared or ultraviolet and/or toxic gas substance sensors 306, 309 and accelerometers 203 may also be provided on the end shield protectors 307, 308.

In the example shown, there may be multiple infrared and/or toxic gas substance sensors 306, 309 and accelerometers 203 located radially surrounding the safety railcar and along the length of the safety railcar. This may provide a level of redundancy (e.g., in the event some sensors 306, 309, 203 are damaged by a railway crash) and may also help to ensure that a fire or release of gas is promptly detected. In some examples, the controller may determine, based on the number and position of the sensors 306, 309, 203 that have been triggered, the location and/or severity of the fire or gas hazard, and may cause release of foam by a selected number of foam tanks and/or by foam tanks in selected locations, as discussed further below.

Figure 5:
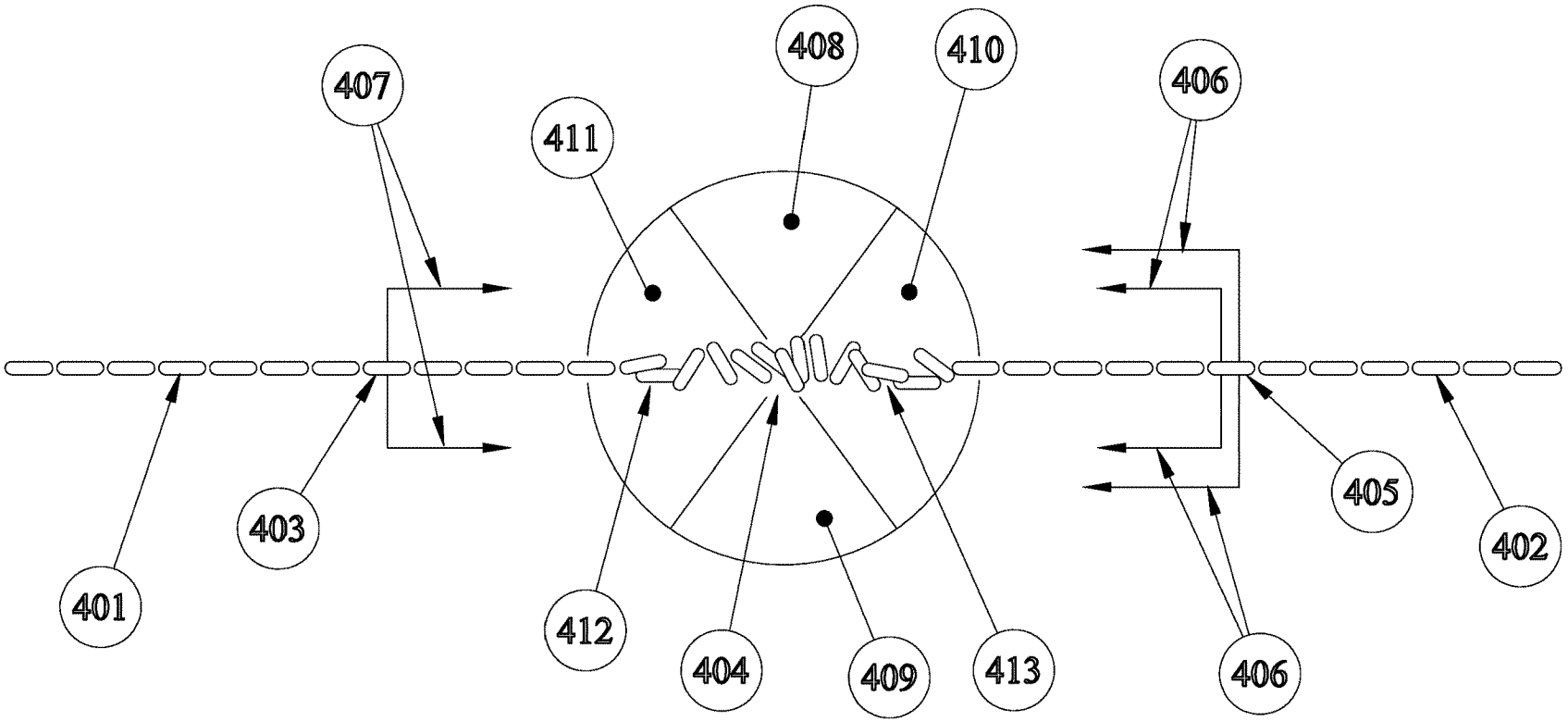
FIG. 5 is a schematic diagram illustrating operation of example safety railcars in a train derailment.

An example operation of the disclosed safety railcar is now described with reference to FIG. 5. FIG. 5 is a sketch of a typical significant derailment. This represents a large scale accident that has been occurring with more frequency. The quantity and spacing of safety railcars 403, 404, and 405 along the train (represented by dashed lines) may be selected to increase effectiveness in preventing an initial small fire or toxic substance release from developing into a major disaster.

Non-derailed railcars 401, 402 are shown as well as derailed cars 412, 413. Safety railcars 403, 404, 405 may be placed every 15 to 20 cars within a unit train, to provide maximum and immediate disaster response. In this example scenario, a safety railcar 404 has experienced a violent shock associated with a derailment and has detected fire on both sides (e.g., detected by accelerometers and/or infrared sensors, as described above). It has automatically deployed foam and is spraying fire depressant in the pattern coverage area shown, specifically the fore and aft areas 408, 409 as well as the side areas 410, 411. It should be noted that in a train accident, the derailed cars 412, 413 typically bunch up in an accordion fashion (meaning the cars 412, 413 end up lined side-by-side). The ability of safety railcar 404 to spray foam from the sides, providing both near-field and somewhat far-field coverage, may be particularly useful in this situation.

The unaffected safety railcars 403 and 405 are available to provide foam for first responders should they require additional foam supply. As discussed above, the safety railcars 403 to 405 may each be equipped with 1000' hoses 406, 407 to enable firefighting capability from significant distances, keeping first responders from harm's way as much as practical. It should be noted that providing hoses and foam supply on the safety railcar may be advantageous over a reliance on fire trucks alone, as there may be instances in which the fire truck simply cannot reach the scene or cannot reach the scene in time, effectively resulting in a late response or no response at all.

Figure 6:
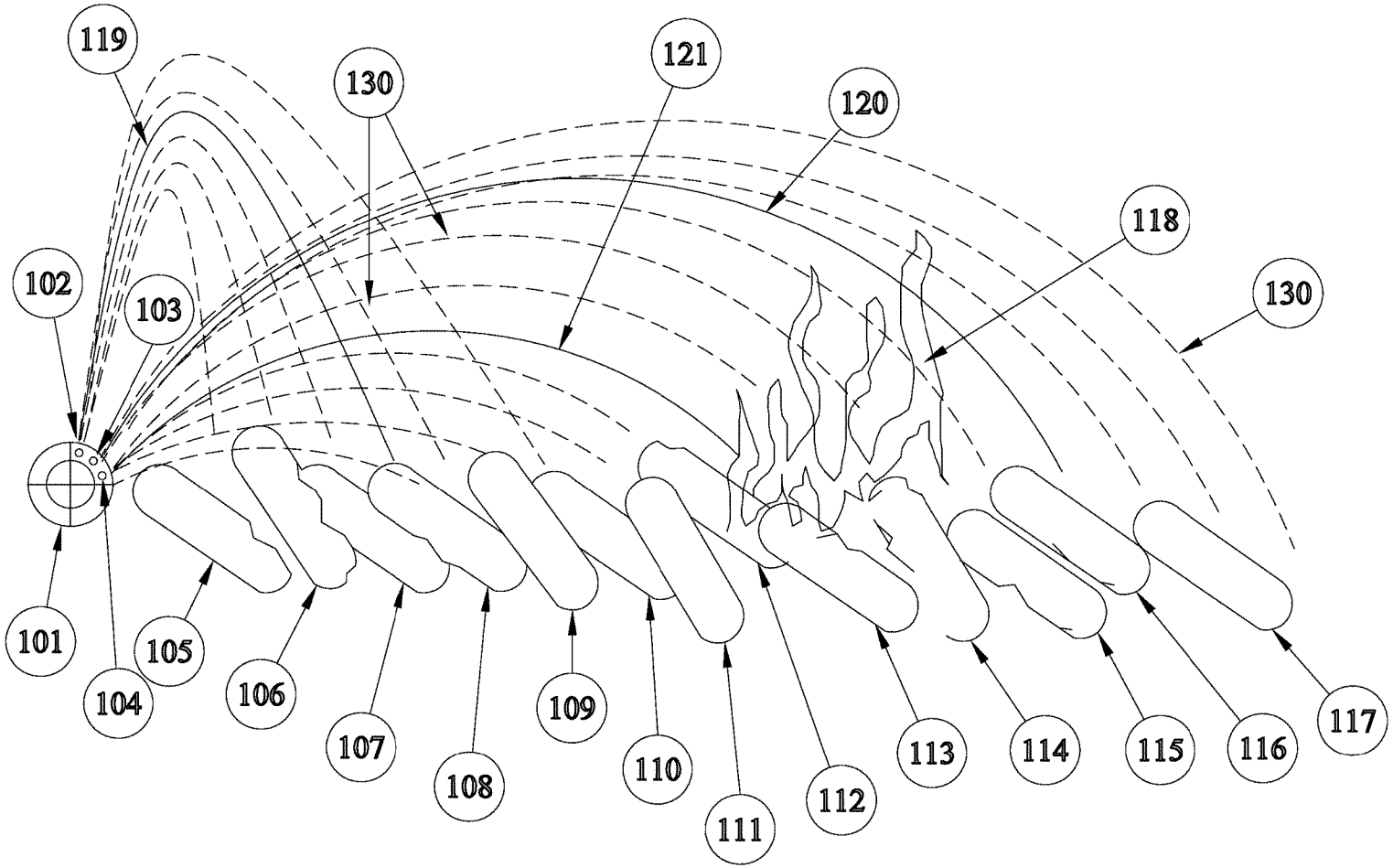
FIG. 6 is another diagram illustrating operation of an example safety railcar.

FIG. 6 shows another view of a typical accident scenario of a derailed train and subsequent fire/toxic substance release. When a flame or toxic substance presence is detected by an onboard infrared and/or toxic substance sensor 306 and/or 309 of a safety railcar, signals from the sensor 306 and/or 309 are sent to the controller 202 which in turn causes release of foam by the foam tanks 12. The programmable logic controller 202 may be programmed such that a minimum of twelve foam tanks 12 will deploy foam, covering a 360 degree area. As another example, the programmable logic controller 202 may be programmed such that a minimum of 3 foam tanks 12 will deploy foam, covering a 90 degree area.

In the example of FIG. 6, a sensor (which may be an infrared sensor) mounted at given radial position 103 (e.g., at the 45° position) of a safety railcar 101 has detected a problem (e.g., a fire 118). A signal from this sensor is sent to the controller 202, which in turn causes all four foam tanks along the length of the safety car at the same radial position 103 (i.e., at the 45° position) to release foam, as well as the foam tanks at adjacent radial positions 102, 104 (i.e., at the 15° and 60° positions). As the foam is ejected from the foam tanks at radial positions 102 to 104, the foam may follow trajectory paths 119 to 121. This range of trajectory may help to provide more uniform coverage over the derailed railcars 105 to 117 for a wide area, as indicated by the dashed lines 130. If the fire continues to spread, additional detectors (e.g., at other radial positions and/or on other safety railcars) will respond and more foam will be automatically deployed from either the same safety railcar 101 or another safety railcar nearby (not shown).

Figure 7:
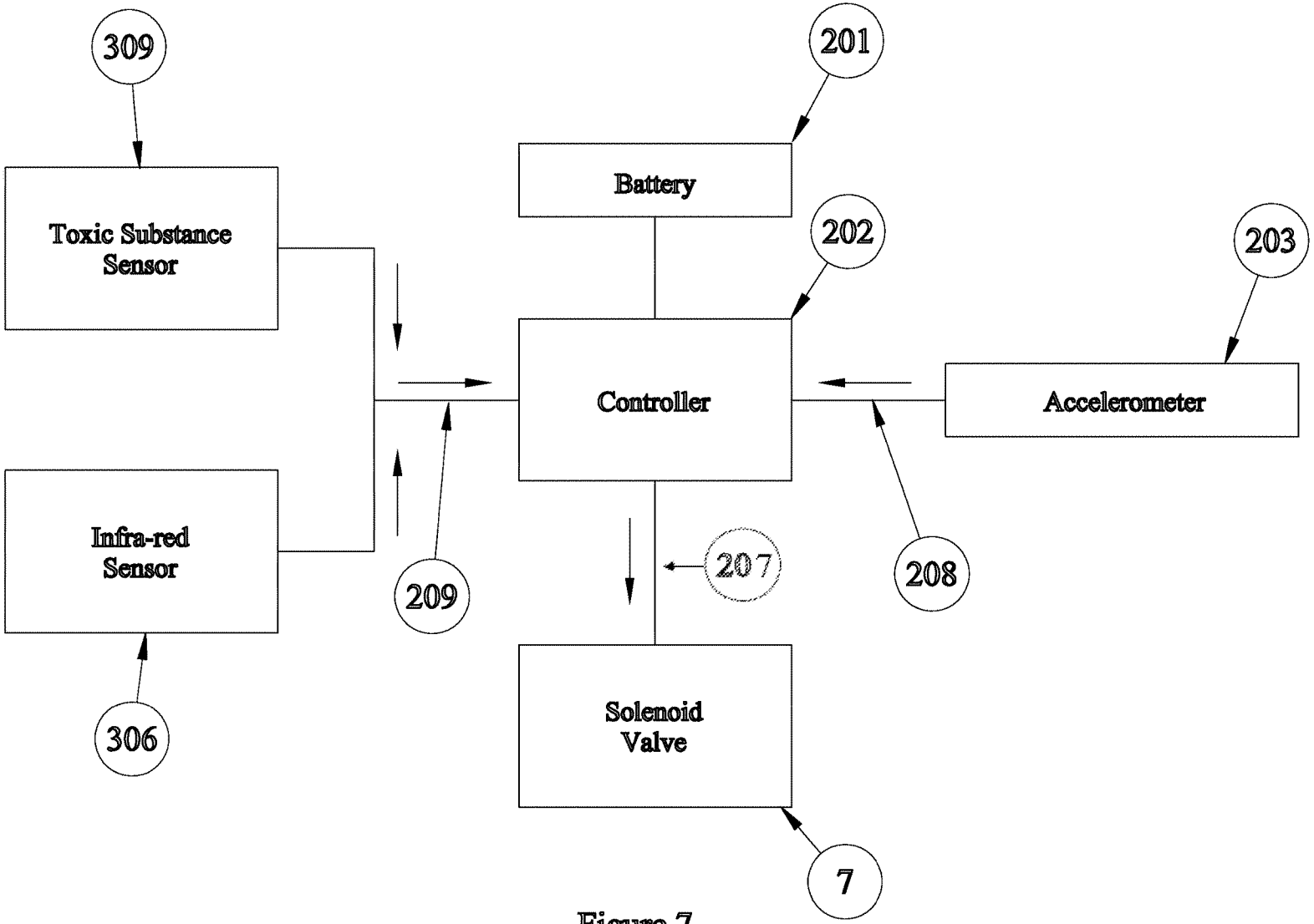
FIG. 7 is a schematic diagram illustrating operation of a controller for an example safety railcar.

FIG. 7 is an electrical logic diagram illustrating operation of the control 202. In this example, the programmable logic controller 202 is powered by a battery 201. Infrared 306 and toxic gas substance 309 detectors are placed around the safety railcar, as described above. Electrically actuated valves 7 (e.g., solenoid valves) which are normally closed are located at the inlet of every foam tank 12. The following logic may be implemented to cause foam to be released.

An accelerometer 203 detects an acceleration profile indicative of a severe railcar accident and the accelerometer 203 sends a signal 208 to the programmable logic controller 202. The signal 208 may be sent via wired (e.g., an electrical cable) or wireless communication. A toxic substance sensor 309 and/or infrared sensor 306 is triggered, sending a signal 209 to the programmable logic controller 202. The signal 209 may be sent via wired (e.g., an electrical cable) or wireless communication. The controller 202 may be programmed such that the controller 202 causes release of foam only if the controller 202 receives a signal from the accelerometer 203 and at least one of the toxic substance sensor 309 or the infrared sensor 306. When these conditions are met, the programmable logic controller 202 sends a signal 207 to the appropriate valves 7 via wired (e.g., via an electrical cable) or wireless communication. As described with respect to FIG. 6, the controller 202 may determine which are the appropriate valves 7 that should be opened, based on the location and/or number of sensors 306, 309 from which the signals 209 is sent. For example, the controller 202 may send the signal 207 only to valves 7 at or around the radial position as the sensor 306 and/or 309 detecting the hazardous condition. The signal 207 causes the normally closed valve 7 to open, allowing the air/water/foam interaction (as described above) to occur, resulting in foam spray to the desired location, such as illustrated in FIG. 6.

In some examples, the programmable logic controller 202 may be programmed to cause the release of a foam suppressant under the sole condition of gas detection by the toxic substance sensor 309 (i.e. without the additional requirement of a signal from the accelerometer 203 indicating a derailment). This may be appropriate when railcars of dangerous goods (e.g., toxic or poisonous gas) are parked at an end user's site or in a rail yard, for example. The safety railcar may be parked in close proximity to the railcars containing the dangerous goods.

In some examples, the programmable logic controller 202 may be programmed to cause the release of a foam suppressant material under the sole condition of fire detection by the infrared sensor 306 (i.e., without the additional requirement of a signal from the accelerometer 203 indicating a derailment). This may be appropriate when the train is parked or when loading and unloading flammable material, and may also be appropriate when railcars of flammable goods are parked at an end user's site, for example. The safety railcar may be parked in close proximity to the railcars containing the flammable goods.

The programmable logic controller 202 may be switched between these modes of operation, depending on how the safety railcar is to be used.

In some examples, manual intervention may terminate foam spray in the event of a misfire or when it has been determined the accident condition is declared under control. For example, a switch (e.g., a remote switch) can be incorporated into the programmable logic controller 202 that would terminate the signal 207 to the valve 7 (or that would send a "close" signal to the valve 7) thus returning the valve 7 to its normally closed position, terminating the flow of foam.

The embodiments of the present disclosure described above are intended to be examples only. The present disclosure may be embodied in other specific forms. Alterations, modifications and variations to the disclosure may be made without departing from the intended scope of the present disclosure. While the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. All values and subranges within disclosed ranges are also disclosed. The subject matter described herein intends to cover and embrace all suitable changes in technology. All references mentioned are hereby incorporated by reference in their entirety.

The invention claimed is:

1. A suppression system in a safety railcar, the suppression system comprising:

a source of pressurized water;

at least one suppressor tank containing a suppression agent, each suppressor tank being connected to receive pressurized water from the source of pressurized water to pressurize the suppression agent;

a controllable valve positioned between the source of pressurized water and the at least one suppressor tank to mediate flow of pressurized water; and at least one spray nozzle connected to receive the suppression agent from each suppressor tank, each spray nozzle being connected to the respective suppressor tank via a rupture disc configured to rupture and permit flow of the suppression agent from the spray nozzle when pressure within the at least one suppressor tank exceeds a predetermined threshold;

the controllable valve being controllable to permit flow of suppression agent in response to detection of a hazardous event.

2. A suppression system of claim 1, wherein the suppression agent is selected from one or more of a dry chemical, a foam, and a wet chemical.

3. A suppression system of claim 2, wherein the dry chemical is selected from one or more of monoammonium phosphate, sodium bicarbonate, potassium bicarbonate, urea complex, potassium chloride, MET-L-KYL/PYROKYL, halon, carbon dioxide, inert gases, sodium chloride, and graphite.

4. A suppression system of claim 2, wherein the wet chemical is selected from one or more of water, antifreeze, potassium acetate, potassium carbonate, and potassium citrate.

5. A suppression system of claim 1, wherein each suppressor tank is connected to receive pressurized water from the source of pressurized water to pressurize the suppression agent; and the controllable valve is positioned to mediate flow of pressurized water from the source of pressurized water to the at least one suppressor tank.

6. The suppression system of claim 1, wherein there is a plurality of suppressor tanks positioned radially about the source of pressurized water.

7. The suppression system of claim 1, wherein the source of pressurized water comprises an air tank containing pressurized air and a water tank containing water, the air tank and the water tank being connected to permit flow of pressurized air to the water tank.

8. The suppression system of claim 7 further comprising at least one non-return valve between the water tank and the air tank to inhibit backflow between the water tank and the air tank.

9. The suppression system of claim 7 further comprising at least one non-return valve between the water tank and the suppressor tank to inhibit backflow between the water tank and the suppressor tank.

10. The suppression system of claim 1 further comprising:

a first manually operable valve operable to permit flow of pressurized water to the at least one suppressor tank to pressurize the at least one suppressor tank to a pressure below the predetermined threshold of the rupture disc; and a second manually operable valve operable to permit flow of suppression agent from the at least one suppressor tank, via a hose outlet.

11. The suppression system of claim 10 further comprising at least one non-return valve for inhibiting backflow from the hose outlet.

12. The suppression system of claim 1, further comprising a controller for controlling the controllable valve and at least one sensor for detecting the hazardous event, wherein the controller causes, in response to a signal from the at least one sensor at a given radial position, opening of the controllable valve mediating flow of pressurized water to the at least one suppressor tank to cause the suppression agent to spray out at the given radial position.

13. The suppression system of claim 12, wherein the at least one sensor comprises at least one of: an accelerometer, an infrared sensor, an ultraviolet sensor, or a toxic substance sensor.

14. The suppression system of claim 13 wherein the accelerometer detects a derailment event; the infrared sensor or the ultraviolet sensor detects a fire, and the toxic substance sensor detects a release of a toxic substance.

15. The suppression system of claim 14 wherein the at least one sensor is placed on a railcar containing dangerous goods such that the signal from the at least one sensor is transmitted wirelessly to the safety railcar when the hazardous event is detected.

16. The suppression system of claim 1 wherein there is at least a first and a second source of pressurized water, each source of pressurized water being surrounded by a respective first and second set of said suppressor tanks, wherein at least some said suppressor tanks in the first set of suppressor tanks is connected to receive pressurized water from the second source of pressurized water, and at least some suppressor tanks in the second set of suppressor tanks is connected to receive pressurized water from the first source of pressurized water.

17. A safety railcar comprising the suppression system of claim 1.

18. The safety railcar of claim 17 comprising railcar wall made of steel having a thickness of at least 0.75".

19. The safety railcar of claim 17 further comprising at least one compartment for storing a firefighting hose.

20. The safety railcar of claim 17 wherein the at least one spray nozzle is of the pivoting type.

* * * * *